US006519875B1

(12) United States Patent
Beard

(10) Patent No.: US 6,519,875 B1
(45) Date of Patent: Feb. 18, 2003

(54) DRIVING AND WALKING SHOE

(75) Inventor: Kevin A. Beard, Westlake Village, CA (US)

(73) Assignee: Piloti Inc., Westlake Village, CA (US)

( * ) Notice: Subject to any disclaimer, the term of this patent is extended or adjusted under 35 U.S.C. 154(b) by 0 days.

(21) Appl. No.: 09/466,623

(22) Filed: Dec. 17, 1999

(51) Int. Cl.[7] ..... A43B 15/00

(52) U.S. Cl. ..... 36/59 C; 36/25 R; 36/69; 36/93; 36/113; 36/34 R

(58) Field of Search ..... 36/25 R, 28, 30 R, 36/32 R, 31, 69, 88, 92, 93, 113, 59 C, 34 R, 35 R; D2/951, 947

(56) References Cited

U.S. PATENT DOCUMENTS 4,187,620 A * 2/1980 Selner ..... 36/28
4,223,459 A * 9/1980 Riggs ..... 36/114
4,307,521 A * 12/1981 Inohara et al. ..... 36/31
4,858,340 A 8/1989 Pasternak
4,890,398 A 1/1990 Thomasson
5,012,597 A 5/1991 Thomasson
5,025,573 A 6/1991 Giese et al.
5,211,076 A 5/1993 Baume et al.
5,469,642 A * 11/1995 Farbman ..... 36/103
5,544,429 A * 8/1996 Ellis, III ..... 36/25 R
D378,871 S * 4/1997 Hatfield ..... D2/953
5,699,628 A 12/1997 Boatwalla
5,875,568 A * 3/1999 Lennihan, Jr. ..... 36/28
5,983,529 A * 11/1999 Serna ..... 36/28
D417,946 S * 12/1999 Turner ..... D2/960

* cited by examiner

*Primary Examiner*—Mickey Yu
*Assistant Examiner*—Jila M. Mohandesi
(74) *Attorney, Agent, or Firm*—Hughes Hubbard & Reed LLP; Ronald Abramson; Peter A. Sullivan

(57) ABSTRACT

A driving shoe that is also comfortable for walking includes extensive cushioning in the shoe's heel regions and sides and a line of substantially constant curvature in the heel region extending to the rear of the shoe that allows for rapid pivoting between the accelerator and brake without having to lift the foot during driving and for a more natural gait during walking.

7 Claims, 3 Drawing Sheets

DRIVING AND WALKING SHOE

This invention relates to a driving shoe which is also comfortable for running and walking. More particularly, it relates to a novel shoe design that uses a rounded heel and extensive heel and side cushioning to improve the efficiency of the foot's motion while driving and the natural stride while walking.

BACKGROUND OF THE INVENTION

The high-performance car racing shoes available do not adequately address two problems facing drivers. First, drivers face intense vibration in the interior of the car. This can lead to foot blistering as the back heel portion and sides of the foot come in contact with inflexible, uncushioned portions of the shoe. This problem is particularly acute around the "ball" of the driver's heel, which is in contact with the vibrating floor of the car. The problem is also present on the sides of the foot, which frequently come in contact with the sides of the shoe, particularly when rapid foot movement between accelerator and brake is necessary. Accordingly, it is particularly desirable in racing driving shoes to have high-quality cushioning in the heel and midsole areas, as well as on the sides of the shoe. Current racing shoes lack this cushioning, with the upper portion of the shoe (the "upper") being bonded or sewn directly to the outsole. The resulting thin shoe frequently causes blistering, wears out very quickly, and subjects the wearer to feeling every stone on the ground through its thin surface when worn outside the car.

A second problem confronting drivers relates to the shape of the heel. Shoes that are currently available have an extended, sharp and laterally-flattened heel that presents problems during driving. When the wearer of such a prior-art shoe sits behind the wheel of a car, with the sole of the shoe resting lightly against the pedals, ready to drive, ("Driving position"), the weight of the legs will be supported only by the sharp edge of the rear segment of the shoe's heel portion. A driver, however, needs a stable and dynamic base for the ball of the heel from which to initiate and control movements of the foot.

To allow for quick action and maximum control, the base must be shaped so as to facilitate rotation in the transverse and coronal planes, and so as to allow for control of the foot's rotation in the sagittal plane. The transverse plane is a plane parallel to the ground that divides the body of a human standing upright on a flat foot into an upper and a lower half, not necessarily equal in size. The sagittal and coronal planes are two planes perpendicular to each other and to the transverse plane, the coronal plane dividing a human standing upright on a flat foot into a front and back half, the sagittal plane dividing that same human into two lateral halves. A coronal-oblique plane lies at an oblique angle to the coronal and transverse planes, perpendicular to the sagittal plane, a transverse-oblique plane lies at an oblique angle to the transverse and sagittal planes, perpendicular to the coronal plane, and a sagittal-oblique plane lies at an oblique angle to the sagittal and coronal planes, perpendicular to the transverse plane.

Although described in relation to the ground plane and a particular position of the body in relation to the ground plane, the planes are considered attached to the body. Thus, in Driving position, rotation of the foot in the transverse plane refers to rotation around the axis of the shin to switch from one pedal to a neighboring pedal, from gas pedal to brake, for example, rotation of the foot in the coronal plane refers to any amount of inversion or eversion of the foot that accompanies the foot's rotation in the transverse plane, and rotation in the sagittal plane refers to flexion of the foot to depress or release a pedal. For example, the shoe of Ellis, U.S. Pat. No. 5,544,429, discloses a heel extended as in other prior art shoes, and does not follow the natural spherical curvature of the human heel. Cf. '429 patent, FIG. 6. When down-shifting, the act of "heeling and toeing," or pivoting simultaneously between a car's accelerator and brake in order to downshift while braking, is difficult since the shape of the shoe does not facilitate the foot's rotation along the coronal and transverse planes.

Flat heels also present a problem for walking. While walking, the heel of the typical shoe extends beyond the rear of the natural heel of the foot. The shoe's extended heel acts as a lever when the wearer's heel contacts the ground, accelerating the step as it enters the pronation phase or "midstance period," where the foot is level with the ground. This premature pronation results in an unnatural walking style. This unnatural walking style is characterized by the "slapping" sound heard when a walker's forefoot hits the ground. Most of the typical racing shoes and driving moccasins worn by drivers have such pronounced heels, and are particularly ill-suited for the task of everyday walking. Natural stride and comfort are also enhanced by "toe spring"—the curvature away from the ground plane from below the metatarsal heads, or "ball of the foot" to the toe. This feature allows a natural roll through the push off phase, or "propulsive period" of the gait cycle.

Existing shoes also lack the capability to minimize discomfort from vehicle vibrations. The lack of a cushioning element for existing driving shoes and driving moccasins results in the foot being subjected to vibrational stresses when it contacts and moves relative to an inflexible part of the interior of the shoe. Intense vibration and rapid movement of the foot while racing can cause blistering as the back heel portion and sides of the foot come in contact with inflexible, uncushioned portions of the interior of the shoe. In the prior art, separate heel liners were often required to solve this problem.

Such uncushioned shoes are also more likely to result in "overuse" injuries, subjecting the foot to repeated stresses and impacts where it is not naturally cushioned or protected.

It is thus an object of the invention to facilitate automobile driving through use of a rounded heel and specially contoured sides of a shoe to simplify "heeling and toeing," the process of rocking the right foot on both the brake and gas pedals in order to downshift while braking.

It is another object of the invention to provide a shoe having a substantial amount of cushioning in the heel and side areas, which can be used to reduce foot stress and blistering while driving.

It is another object of the invention to provide a shoe that allows for a natural stride. This is done by approximating the natural shape of the heel through use of a rounded or spherical heel.

SUMMARY OF THE INVENTION

According to one aspect of the invention, driving or walking shoes are extensively cushioned in the heel, midsole and sides of the sole in order to prevent discomfort and blistering. The sole of a shoe has a toe region at a distal end of the sole, and a heel region at a proximal end of the sole. The sole of the shoe includes a metatarsal region, corresponding to the metatarsal bone of the foot, positioned substantially between toe and heel regions and along an inner side of the sole, said toe region extending upward from the metatarsal region in order to follow the natural curvature of the foot and to facilitate "toe spring" (the natural curvature away from the transverse plane from below the metatarsal heads, or "ball of the foot" to the toe), which enhances natural stride and comfort. The heel of the shoes, which rest on the floor of the car while driving, have a rounded bottom contour to facilitate "heeling and toeing" (rocking the right foot on both the brake and gas pedals in order to downshift while braking). The sides of the shoes are also contoured to facilitate this movement.

The rounded heel of the claimed shoe extends the athletic construction cushioning of the midsole up the heel of the shoe to counteract this problem. This extension of cushioning is also present on the sides of the shoes, especially at the forefoot to cushion contact with the sides of the foot well. The shoe also uses wraps (made of rubber, expanded foam, or similar cushioning material) at the heel and on the lateral side of the shoe to provide addition al protection and grip on the pedals and floor. The heel wraps also provide greater durability and grip. The rounded heel not only benefits a driver in a car by providing a cushioned area, instead of an edge at the bottom of a typical heel, it also allows a natural impact and roll into the gait cycle while walking.

DETAILED DESCRIPTION OF THE DRAWINGS

Figure 1:
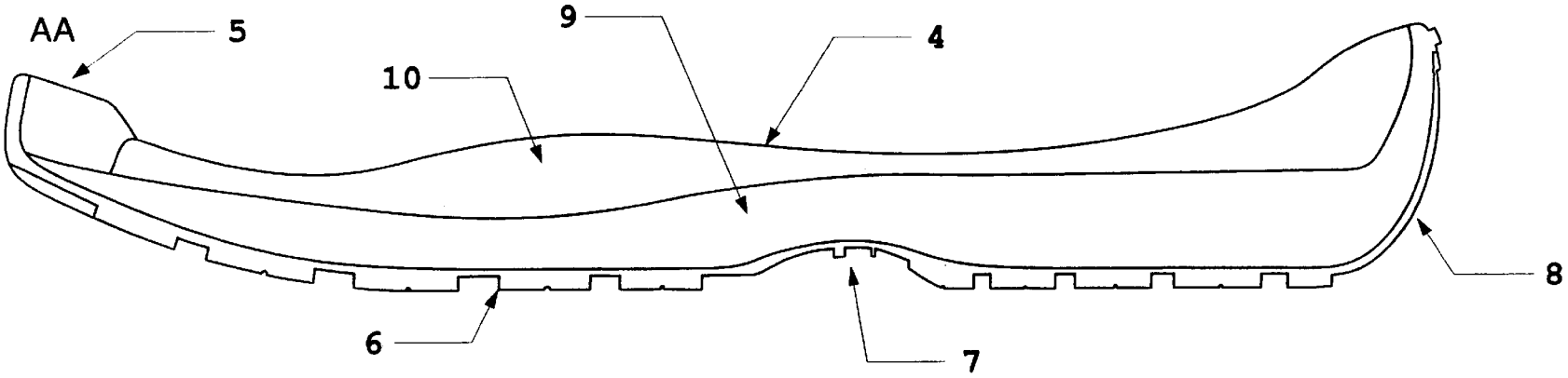
FIG. 1 is a side sagittal plane cross-sectional view of a shoe sole taken substantially along line A—A of FIG. 3*a*.

Referring to FIG. 1, the sole 4 depicted is shown to comprise a toe region 5, a metatarsal region 6, an arch region 7 forward of a heel portion 8. FIG. 1 also depicts a cushioned base region 9, as well as cushioned side walls 10 extending upward from the cushioned base region 9.

Figure 2:
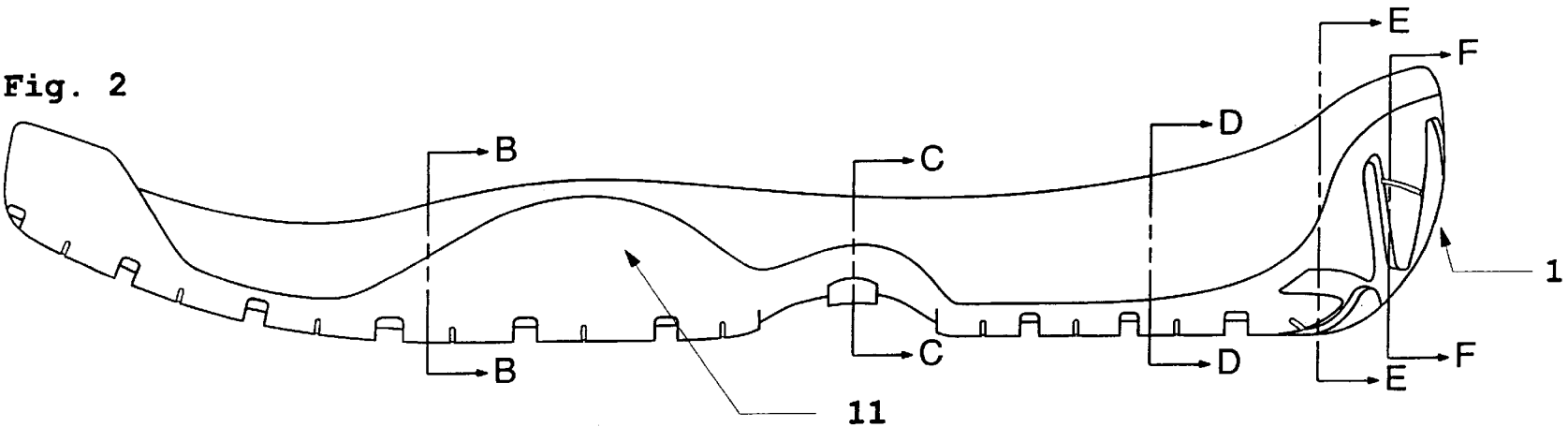
FIG. 2 is a side sagittal plane view of the exterior side of a shoe sole.

FIG. 2 is a side sagittal plane view of a shoe sole. It depicts the rounded heel portion 1 and its associated wrap (made of rubber, expanded foam or similar cushioning material) covering this portion. In this embodiment, the rounded heel portion 1 gradually curves from a position below the base of the heel to a position approximately perpendicular to such position. Thus, the rounded shape approximates that of a human heel. In another embodiment, the heel approximates the shape of a quarter-sphere. In still other embodiments, looking in the sagittal plane, the heel portion slopes upward toward the end of the heel in the approximate shape of a quarter-circle.

FIG. 2 also depicts the wrap 11 extending up the outside wall of the shoe to the side of the metatarsal region. Such wraps at the heel and on the lateral side of the shoe provide greater durability and additional protection and grip on the pedals and floor.

Figure 3B:
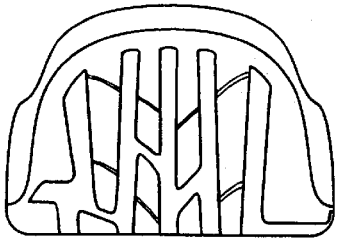
FIG. 3*b* is an elongated view of the portion beginning with line E—E of FIGS. 2, 3*a* and 4 and extending in an rounded manner up the heel of the shoe sole.
Figure 3A:
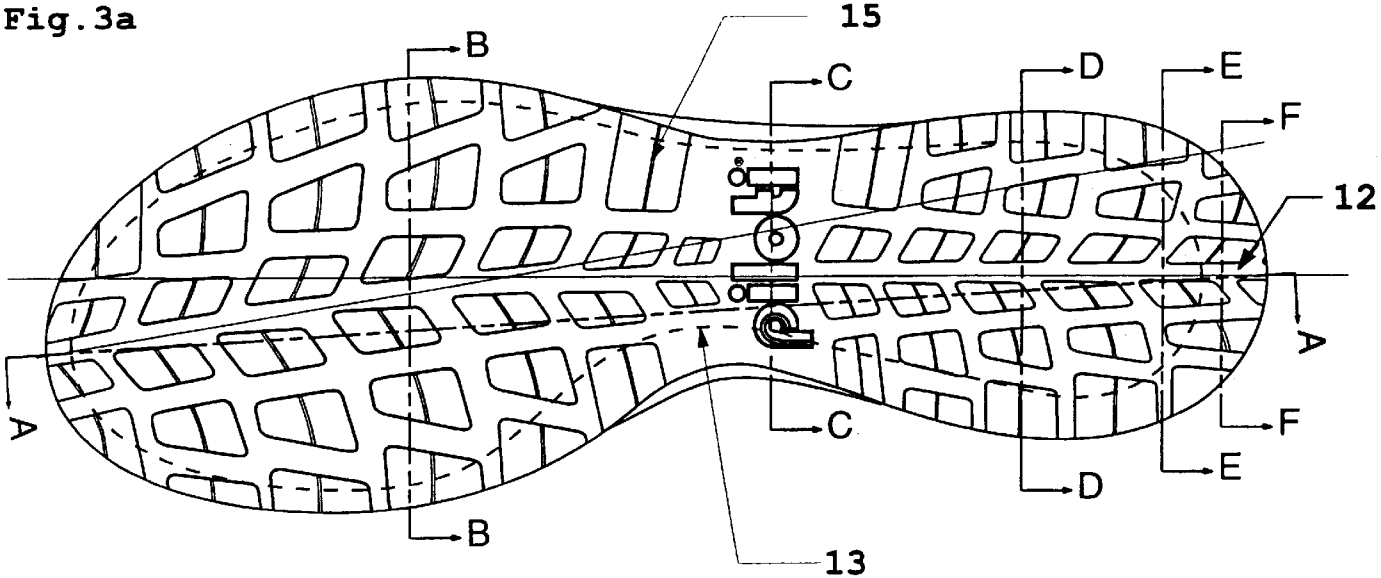
FIG. 3*a* is a bottom plan view of the exterior side of a shoe sole.

A bottom plan view of the exterior side of the shoe sole is depicted in FIG. 3*a*. The rounded heel portion 12 is shown in part. Also shown in FIG. 3*a* is line A—A, which in connection with the heel portion of shoe sole shown, divides the heel portion into an inner portion and an outer portion along a plane defined by line A—A across the sole and extending vertically. The upper rounded heel portion 13 is further shown in FIG. 3*b*, an elongated, "flattened" view of the portion beginning with line E—E of FIGS. 2, 3*a* and 4 and extending in a rounded manner up the heel of the shoe sole. The base of the interior portion 13 of the shoe is outlined by a dotted line. The shoe tread pattern 15 may be varied to suit particular uses or fashions without affecting the objects of the invention.

Figure 4:
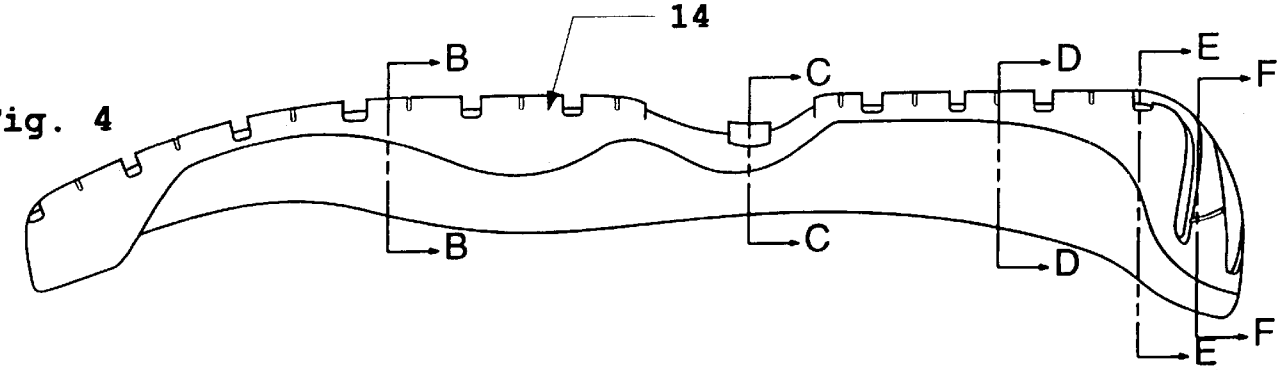
FIG. 4 is a side sagittal plane view of the interior side of a shoe sole.

FIG. 4 shows a side sagittal plane view of the interior side of a shoe sole. In the preferred embodiment, the wrap 14 on the lateral side is less pronounced than that on the exterior side.

Figure 5:
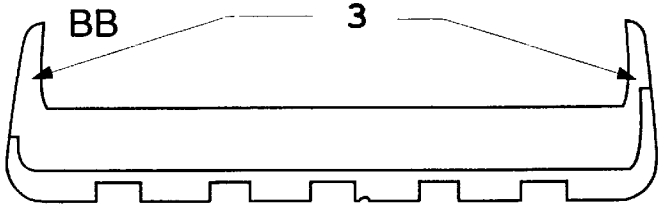
FIG. 5 is a cross-sectional coronal plane view taken along line B—B of FIGS. 2, 3*a* and 4.

FIGS. 5, 6, 7, 8 and 9 show cross-sectional coronal plane views of the shoe sole taken at various points from toe to heel. The views are from the front or distal side. FIG. 5 is a cross-sectional view taken substantially along line B—B of FIGS. 2, 3*a* and 4, cutting through the metatarsal region The wrap 11 is shown on the base and sides of this cross-section. It is apparent from this view that the wrap 11 in this embodiment extends higher up the side of the shoe on the exterior side, away from the body. The cushioned region 3 can also be seen to extend upward on the sides in order to protect the sides of the foot from contact with the attached, inflexible "upper" of the shoe. The use of an athletic construction enhances "toe spring," the gradual upward curvature from the ground plane from below the metatarsal heads to the toe. This enhances natural stride and comfort.

Figure 6:
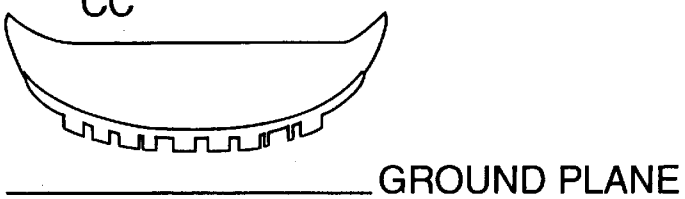
FIG. 6 is a cross-sectional coronal plane view taken along line C—C of FIGS. 2, 3*a* and 4.

FIG. 6 depicts a similar view along the C—C axis of FIGS. 2, 3*a* and 4, showing a cross section of the arch region 7. In the depicted embodiment, this region is extended above the ground.

Figure 7:
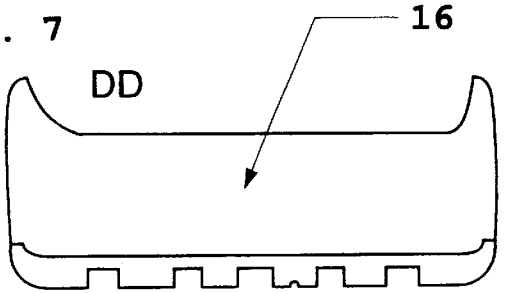
FIG. 7 is a cross-sectional coronal plane view taken along line D—D of FIGS. 2, 3*a* and 4.
Figure 9:
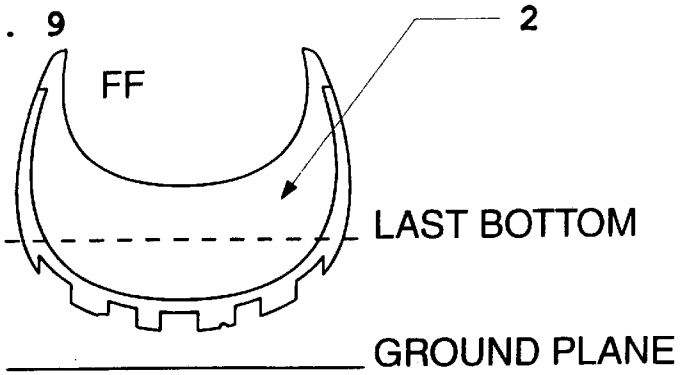
FIG. 9 is a cross-sectional coronal plane view taken along line F—F of FIGS. 2, 3*a* and 4.
Figure 8:
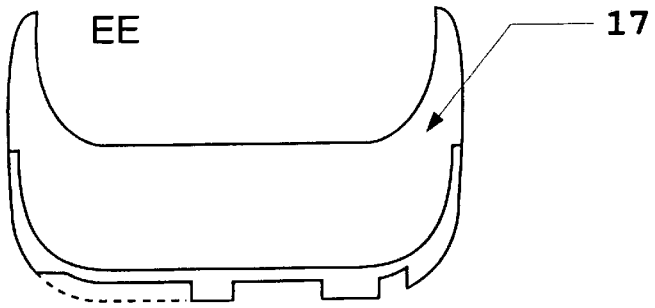
FIG. 8 is a cross-sectional coronal plane view taken along line E—E of FIGS. 2, 3*a* and 4.

FIGS. 7, 8 and 9 show the substantially cushioned heel area 16, 17, 2 along the D—D, E—E and F—F axes of FIGS. 2, 3*a* and 4. As discussed above, the shoes can be comfortably worn outside the car. Existing shoes lack a cushioning element of an athletic material construction. This lack of a cushioning element in this position for existing driving shoes and driving moccasins results in stress when the foot contacts and moves relative to an inflexible part of the interior of the shoe. In the preferred embodiment, an athletic construction of polyurethane (PU) foam or ethyl vinyl acetate (EVA) foam or similar cushioning material is used to reduce vibration and other motion-related stresses. The heel area has extensive lower heel cushioning with gradually increasing side cushioning as one progresses to the proximal end of the shoe. The distance between the base of the shoe and the ground in FIG. 9 reflects the upward curve of the rounded heel portion 1 at this point. Cushioning thickness would vary based on the size of the shoe, but in most embodiments would be in the range of 3 to 10 mm under the forefoot and 13 to 20 mm under the heel.

I claim:

1. A shoe comprising a forefoot portion and a heel portion, said heel portion having a central plane dividing said heel portion into an inner portion and outer portion, said heel portion having a tread extending from a bottom-most point in said central plane to a rear-most point in said central plane, said tread having a shape in said central plane of an arc of substantially constant curvature measured from a first point substantially near said bottom-most point and extending to a second point substantially near said rear-most point.

2. The shoe of claim 1 wherein said tread has a shape of substantially constant curvature in a plane perpendicular to a slope of a point along said arc.

3. The shoe of claim 2 wherein said point is equidistant between said first point and said second point.

4. The shoe of claim 1 wherein said forefoot portion and said heel portion comprise an energy absorbing material.

5. The shoe of claim 4 wherein said energy absorbing material is chosen from the group of polyurethane (PU) foam, ethyl vinyl acetate (EVA) foam or other foam cushioning material.

6. The shoe of claim 2 wherein said forefoot portion and said heel portion comprise an energy absorbing material.

7. The shoe of claim 6 wherein said energy absorbing material is chosen from the group of polyurethane (PU) foam, ethyl vinyl acetate (EVA) foam or other foam cushioning material.

* * * * *